United States Patent [19]

Sougawa

[11] Patent Number: 4,986,780

[45] Date of Patent: Jan. 22, 1991

[54] TWO CYCLE ENGINE

[75] Inventor: Masafumi Sougawa, Hamamatsu, Japan

[73] Assignee: Sanshin Kogyo Kabushihi Kaisha, Hamamutsu, Japan

[21] Appl. No.: 240,924

[22] Filed: Sep. 6, 1988

[30] Foreign Application Priority Data

Sep. 4, 1987 [JP] Japan ..... 62-222651

[51] Int. Cl.[5] ..... B63H 21/32

[52] U.S. Cl. ..... 440/89; 123/323

[58] Field of Search ..... 440/88, 89; 123/65 PE, 123/73 R, 323

[56] References Cited

U.S. PATENT DOCUMENTS 4,341,188 7/1982 Nerstrom ..... 123/65 PE 4,399,788 8/1983 Bostelmann ..... 123/65 PE 4,793,347 12/1988 Taniuchi et al. ..... 123/65 PE

FOREIGN PATENT DOCUMENTS 468143 9/1950 Canada ..... 440/89

*Primary Examiner*—Joseph F. Peters, Jr.

*Assistant Examiner*—Jesus D. Sotelo

*Attorney, Agent, or Firm*—Ernest A. Beutler

[57] ABSTRACT

Several embodiments of outboard motors embodying two cycle internal combustion engines having an exhaust control valve and a decompression control valve that is operated in response to engine operating characteristics to improve performance and reduce noise. Embodiments are disclosed wherein the control is in response to throttle valve position, engine speed and/or exhaust gas pressure.

15 Claims, 6 Drawing Sheets

TWO CYCLE ENGINE

BACKGROUND OF THE INVENTION

This invention relates to a two cycle engine and more particularly to a two cycle engine as utilized in conjunction with an outboard motor.

As is well known, two cycle engines have a great versatility and wide application due to their extremely compact nature and the simplicity in their construction. In addition, such engines normally produce a high output for a given displacement due to the fact that the power cycle occurs during every crankshaft revolution as opposed to a four cycle engine wherein the engine fires and supplies power only every other crankshaft revolution. In order to increase the performance of such engines, and particularly to improve the scavenging efficiency, it has been the practice to provide porting arrangements wherein there is a substantial overlap between the opening of the intake port and the closing of the exhaust port. Such high overlaps provide good scavenging and high performance. However, at low engine speeds the port overlap can cause rough running and otherwise poor performance.

As a result, the port timing has been a compromise between good running at low speeds and maximum performance. In order to avoid these compromises, it has been proposed to employ an exhaust control valve in the exhaust port for controlling both the back pressure and the timing of the opening of the exhaust port. Various arrangements have been incorporated for controlling the timing of the exhaust port and the exhaust gas pressures through the manipulation of this valve.

In addition, it has also been proposed to incorporate a decompression device for facilitating starting in two cycle engines and running at idle or lower speed. Such decompression devices normally open the combustion chamber to the exhaust port during at least a portion of the operation so as to assist in starting, particularly by hand, by reducing the cranking pressure. Of course, such decompression ports should be closed during normal and particularly high speed running so as to avoid a loss in power output.

The opening of the decompression valve and the opening of the valve controlling the exhaust port also can significantly effect the exhaust noises generated by the engine. Obviously, the greater the amount of exhaust gasses flowing into the exhaust system and also the opening of the decompression port can significantly increase the exhaust noise. Therefore, the control of these valves also is dictated in part by the silencing system for the engine and the amount of noise which must be suppressed.

Although the use of decompression in exhaust port valves is fairly well known in two cycle engines, the application of these principles has, for the most part, not been applied to outboard motors. One reason for this is that an outboard motor, because of its unique exhaust system, presents different problems than those encountered with other applications of two cycle internal combustion engines. In conjunction with an outboard motor, it is the normal practice to discharge the exhaust gases through an underwater exhaust gas discharge. In this way, the body of water in which the outboard motor is operating can be used as a silencing device for the exhaust gases. With such underwater exhaust gas discharges, the depth of submersion of the discharge varies on the speed of the associated watercraft and frequently above the water exhaust gas discharges are employed for operating at low speeds.

It is, therefore, a principal object of this invention to provide an improved arrangement for controlling the exhaust port in an outboard motor embodying a two cycle internal combustion engine.

It is a further object of this invention to provide an arrangement for controlling the flow of exhaust gases through the exhaust system of an outboard motor so as to improve performance and reduce sound.

It is a further object of this invention to provide an improved decompression system for an outboard motor.

SUMMARY OF THE INVENTION

A first feature of this invention is adapted to be embodies in an outboard motor that comprises a powerhead including a two cycle, crankcase compression, internal combustion engine that drives a crankshaft. A lower unit depends from the powerhead and carries propulsion means driven by the crankshaft. The outboard motor includes an exhaust port in the engine for receiving exhaust gases and discharging them. An exhaust system extends from the exhaust port through the lower unit and terminates in a underwater exhaust gas outlet for discharging exhaust gases from the engine to the atmosphere through the body of water in which the outboard motor is operating. The degree of submersion of the exhaust gas outlet depends upon the speed of travel of the outboard motor through the body of water. In accordance with this feature of the invention, an exhaust control valve is positioned in the exhaust system for controlling the flow of gases through the exhaust system.

Another feature of the invention is also adapted to be embodied in an outboard motor comprising a powerhead including an engine driving a crankshaft and a lower unit that depends from the powerhead and carrying propulsion means driven by the engine crankshaft. In accordance with this feature of the invention, the outboard motor is provided with an exhaust system that includes an underwater exhaust gas discharge through which exhaust gases are discharged. The degree of submersion of this underwater exhaust gas outlet depends upon the speed of the outboard motor in the body of water. A decompression passage is provided for permitting part of the compressed charge in the engine to pass into the exhaust system. In accordance with this feature of the invention, the flow through the decompression passage is controlled by a valve.

DETAILED DESCRIPTION OF THE PREFERRED EMBODIMENTS OF THE INVENTION

Figure 1:
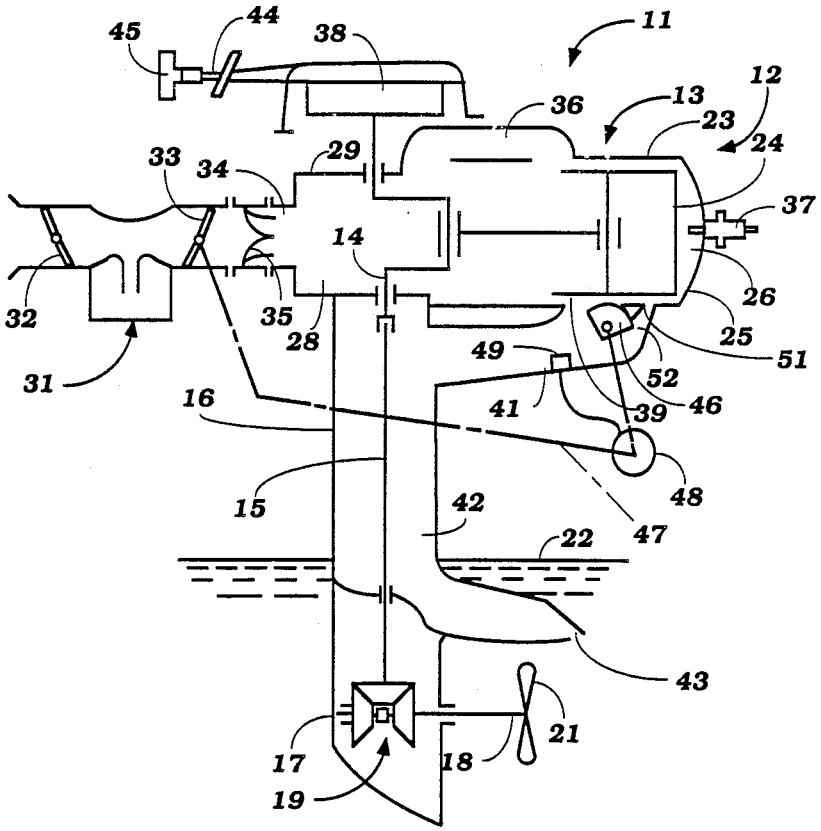
FIG. 1 is a partially schematic cross-sectional view taken through an outboard motor constructed in accordance with a first embodiment of the invention.

Referring first to FIG. 1, and outboard motor constructed in accordance with an embodiment of this invention is identified generally by the reference numeral 11. The outboard motor 11 is comprised of a powerhead assembly, indicated generally by the reference numeral 12 and which includes an internal combustion engine 13 and a surrounding protective cowling, which is removed in the figures. The engine 13 may be of any known configuration but is comprised of a crankcase compression, two cycle type of engine.

Since the engine may be of any configuration, only a single cylinder engine is depicted. The engine 13 drives a crankshaft 14, in a manner to be described, which rotates about a generally vertically extending axis, as is typical practice with outboard motors. The crankshaft 14, in turn, is coupled to a drive shaft 15 that is journaled within a drive shaft housing 16 that depends from the powerhead 12.

Beneath the drive shaft housing 16 there is provided a lower unit 17 in which a propeller shaft 18 is rotatably journaled. A forward, neutral, reverse transmission 19 of a known type selectively couples the drive shaft 15 to the propeller shaft 18 for rotating the propeller shaft in selected forward, neutral or reverse modes. A propeller 21 is affixed to the propeller shaft 18 for powering an associated watercraft (not shown) through a body of water 22.

The engine 13, which is shown only schematically since, except as will hereinafter be noted, it may be considered to be conventional, is comprised of a cylinder block 23 in which one or more cylinder bores are formed. Pistons 24 reciprocate in the cylinder block 23 and cooperate with the cylinder block 23 and a cylinder head 25 to define combustion chambers 26.

The pistons 24 are connected by means of connecting rods 27 to the crankshaft 14 for effecting its reciprocation.

A sealed crankcase chamber 28 is associated with each piston 24 and is defined by the cylinder block 23 and a crankcase 29 that is affixed to the cylinder block 23 in a known manner. A fuel air charge is delivered to these crankcase chambers 28 by means of a charge forming device in the form of a carburetor 31. The carburetor 31 is provided with the normal fuel circuits and includes a choke valve 32 for cold starting enrichment and a throttle valve 33 for controlling the speed of the engine. The throttle valve 33 is operated by means of a suitable operator control (not shown).

The carburetor 31 discharges into an intake manifold 34 through reed type check valves 35. The check valves 35 permit flow from the carburetor 31 into the crankcase chambers 28 but prevent reverse flow, as is well known.

The charge which has been drawn into the crankcase chambers 28 on the upward movement of the piston 24 is compressed when the piston 24 moves downwardly. The compressed charge is then transferred to the combustion chamber 26 through one or more scavenge or transfer passages 36 that are formed in the cylinder block 23. The charge which is transferred into the combustion chambers 25 is fired by means of a spark plug 37 that is supported in the cylinder head 25. The spark plug 37 is fired by means of an agitation system including a flywheel magneto generator 38 of a known type.

The exhaust gases from the combustion chamber 28 are discharged through an exhaust port 39 formed in the cylinder block 23 and which communicates with an exhaust manifold 41. The exhaust manifold 41 in turn communicates with an expansion chamber 42 formed in the drive shaft housing 16 for silencing of the exhaust gases. The exhaust gases are then discharged to the atmosphere through the body of water 22 by means of an underwater high speed exhaust gas discharge 43. The exhaust gas discharge 43 is formed in proximity to the propeller 21, although the invention may be equally as well practiced with through the hub exhaust gas discharge. As a result, the degree of submersion of the exhaust gas discharge 43 will depend upon the speed at which the associated watercraft is traveling. At higher speeds, the discharge 43 will be less submerged than at lower speeds. As a result, the back pressure on the exhaust gases due to the degree of submersion of the exhaust gas discharge 43 will increase as the speed of the watercraft decreases. This is significant, for a reason to be described.

The outboard motor 11 is provided with a pull type starter, which is incorporated within the flywheel magneto assembly 38 and which includes a starter rope 44 and pull handle 45 that is juxtaposed to the operator.

As is well known, there is normally a fair degree of overlap between the opening of the exhaust port 39 and the closing of the intake port 36 due to the reciprocation of the piston 24. Although this improves high speed performance, it can adversely effect slow speed performance. In order to improve running throughout the engine load and speed ranges, there is provided an exhaust port control valve member 46 that is supported in the exhaust manifold 41 in proximity to the exhaust port 39 and which is rotatably so as to effect the timing at which the exhaust port 39 opens. The exhaust control valve 46 is operated partially in response to the position of the throttle valve 33 by means of a linkage system, indicated schematically at 47. There is provided further a control mechanism 48 that is interposed in this linkage system and which receives a pressure signal from a pressure transducer 49 in the manifold 41. The operation is such that generally the timing f the closing of the exhaust control valve 46 is such that it is closed at low engine speeds and low exhaust gas pressures and opens as the engine speed increases. However, due to the variety of depth of submersion of the underwater exhaust gas discharge 43, the exhaust pressure may rise at lower engine speeds and the exhaust control valve 49 is operated so as to maintain a high enough pressure in the exhaust manifold 41 so at to insure good exhaust gas discharge and noise reduction.

There is also provided a decompression port 51 in the combustion chamber 26 that cooperates with a decompression passage 52 that communicates with the exhaust manifold 41. The exhaust control valve member 46 is disposed so that as the exhaust port 39 is opened so as to advance its timing, the decompression port 52 is closed and vice verse. The control mechanism 48 is designated so that on starting the exhaust control valve 46 will be in a position to retard the opening of the exhaust port 39 and open fully the decompression passage 52 so as to facilitate starting. Once the engine is started, the exhaust control valve 46 will be moved so as to close off the decompression port 52 and effect increased compression and reduced engine nose due to the lack of decompression relief.

Thus, it should be readily apparent that a single control valve member 46 is operative to control both the exhaust port timing and the decompression timing thus providing extreme simplicity in the system. In addition, both controls may be operated by means of exhaust gas pressure or exhaust gas pressure may only be employed to control the operation of the valving of the exhaust port 39.

Figure 2:
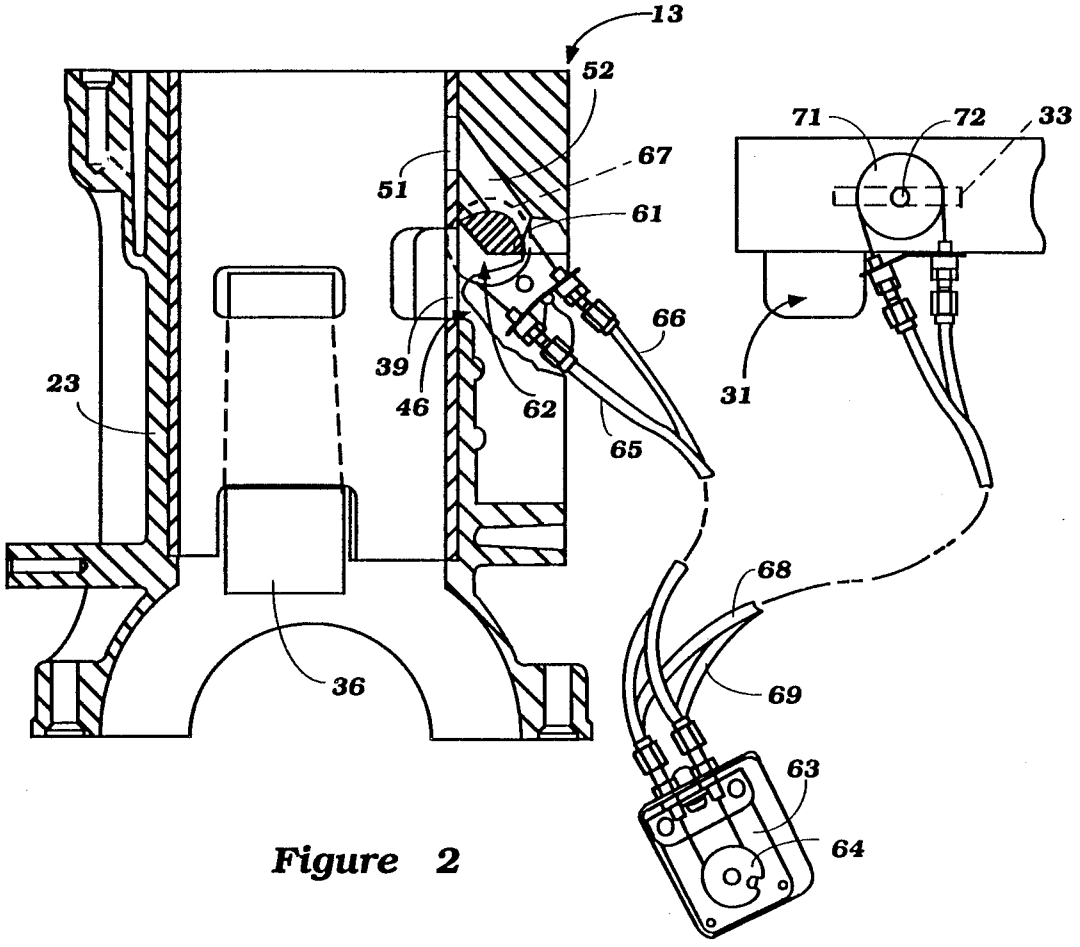
FIG. 2 is a cross-sectional view taken through a port of an outboard motor constructed in accordance with yet another embodiment of the invention.

FIG. 2 shows another embodiment of the invention wherein the basic engine construction is the same as the embodiment of FIG. 1 and only the mechanism for actuating the throttle valve 33 and combined exhaust port and decompression port c control valve 46 is different. For this reason, components which are the same as the previously described embodiment have been identified by the same reference numeral and will not be described against except insofar as is necessary to understand the construction and operation of this embodiment.

In FIG. 2, further details of the exhaust and decompression control valve 46 are illustrated. It may be seen that the valve 46 has a section 61 that serves to obstruct the decompression passage 52 and exhaust port 39 depending upon its angular position. The position shown in FIG. 2 in the wide open throttle position wherein the decompression passage 52 is completely closed off and the exhaust port 36 is not obstructed at all. The valve 46 has a relief 62 through which the exhaust gases may pass unobstructedly.

In this embodiment, the valve 46 and the throttle valve 33 are both controlled by means of a servo motor 63 that receives an input signal from the operator as to desired speed and also a pressure input signal from the sensor 49 so as to control the position of the valves 46 and 33. The servo motor 63 drives a pair of pulleys including a pulley 64 around which are trained a pair of flexible transmitters 65 and 66. These transmitters cooperate with a pulley 67 that is affixed to the shaft 46 for rotating it.

In a similar manner, there is provided another pulley (not shown) that drives a pair of flexible transmitters 68 and 69 which, in turn, cooperate with a pulley 71 affixed to the shaft 72 on which the throttle valve 33 is affixed for rotating the throttle valve.

Figure 3:
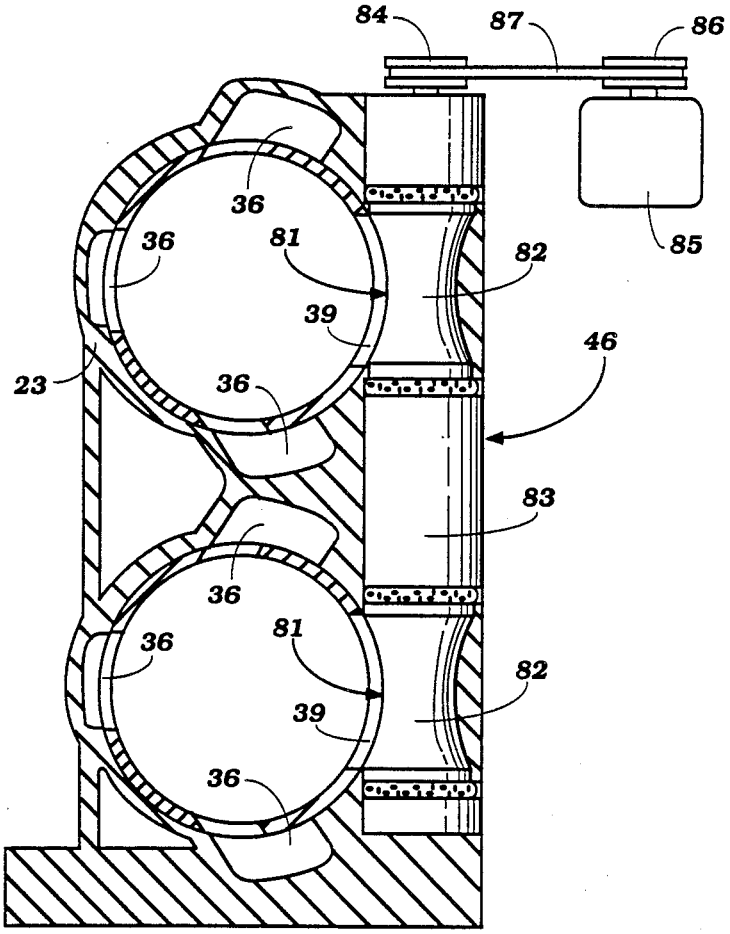
FIG. 3 is a cross-sectional view on an enlarged scale taken through a portion of an internal combustion constructed in accordance with yet another embodiment of the invention.

FIG. 3 shows a slightly different embodiment of the invention and depicts how the invention can be applied to a two cylinder engine that has a single valve 46 that cooperates to control the flow through exhaust ports 39 of two adjacent cylinders. In this embodiment, the valve, indicated generally by the reference numeral 46, comprises a pair of valving portions 81 that have parts 82 that selectively obstruct the exhaust ports 39 or decompression passages, which do not appear in this figure. The valve 46 has a cylindrical center portion 83 that is journaled for rotation in the cylinder block 23. A pulley 84 is affixed to an extending portion of the valve 46 and is driven by a servo motor 85 that is controlled in a manner as aforedescribed. The servo motor output shaft has affixed to its a pulley 86 and a belt or flexible transmitter 87 transmits drive from the servo motor pulley 86 to the shaft pulley 84.

Figure 4:
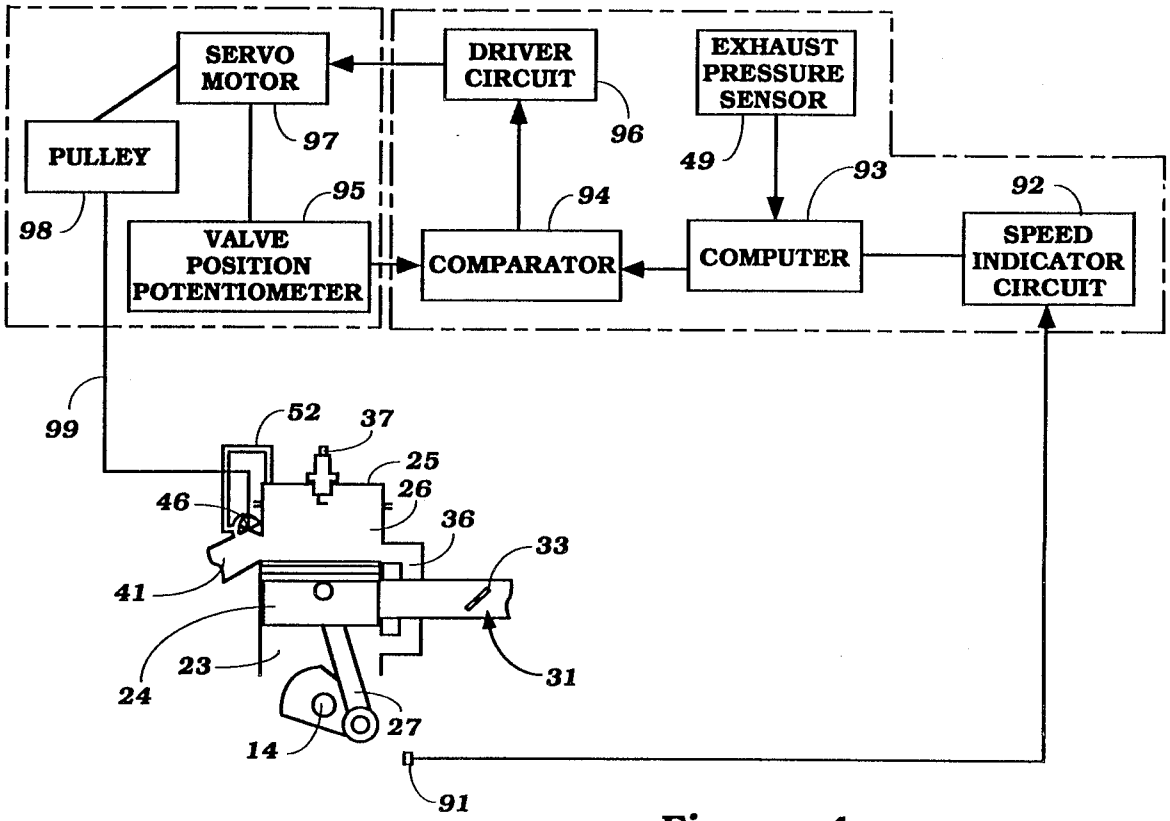
FIG. 4 is a partially schematic cross-sectional view showing another embodiment of the invention.

FIG. 4 shows another embodiment of the invention which is generally similar to the embodiments previously described. For that reason components which are the same as those previously described have been identified by the same reference numeral and will be described again only insofar as is necessary to understand the construction and operation of this embodiment.

This embodiment differs from the previously described embodiments in providing control of the valve 46 in response to engine speed rather than position of the throttle valve angle. To this end, there is provided an engine speed sensor 91 that outputs a signal to a speed indicating circuit 92. The speed indicating circuit 92 outputs its speed signal to a computer 93. The computer 93 also receives an exhaust pressure signal from the pressure sensor 49. The computer 93 is programmed so as to provide the desired angle of the combined decompression and exhaust control valve 46 and outputs a control signal to a comparator 94. The comparator 94 also receives a signal from a potentiometer 95 that indicates the actual position of the valve 46. The comparator then determines if the valve 46 is not in the desired angle and if so outputs a correction signal to a driver circuit 96. The driver circuit 96 operates a servo motor 97 which has affixed to its output shaft a pulley 98. The pulley 98 drives a flexible transmitter or belt 99 to control the position of the valve 46, as aforedescribed.

Figure 5:
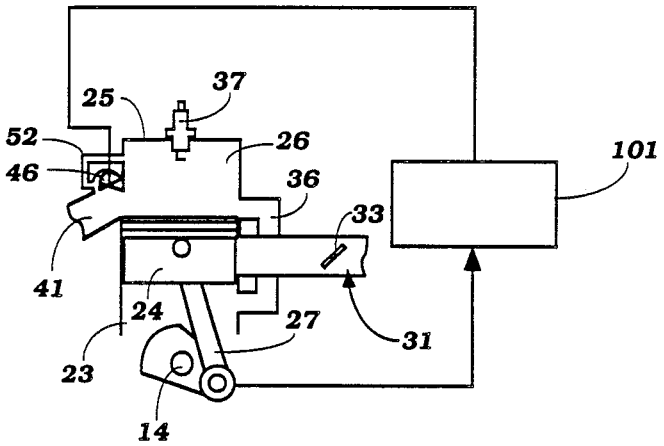
FIG. 5 is a partially schematic cross-sectional view showing yet another embodiment of the invention.

FIG. 5 shows another embodiment of the invention which is generally similar to the embodiment of FIG. 5. In this embodiment, however, the crankshaft 14 drives a centrifugal governor 101 which provides a control signal indicative of speed for controlling the position of the valve 46.

Figure 6:
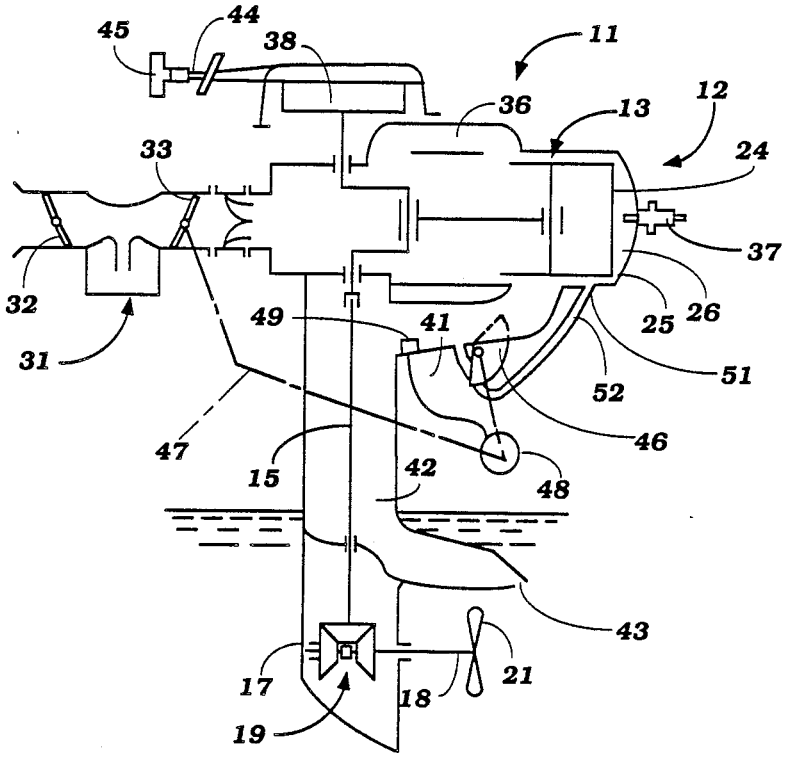
FIG. 6 is a partially schematic cross-sectional view, in part similar to FIG. 1, showing an outboard motor constructed in accordance with yet another embodiment of the invention.

FIG. 6 shows an embodiment of the invention which is generally similar to the embodiment of FIG. 1. In this embodiment, however, the valve 46 rather than controlling the opening of the exhaust port 39 has a portion that extends into the exhaust manifold 41 and will obstruct its flow area. Thus, this device has generally the same operation as the previously described embodiments but rather than changing exhaust valve timing, it changes the restriction in the exhaust manifold. In all other aspects, this embodiment is the same as those previously described and for that reason further description of this embodiment is not believed to be required.

In all of the embodiments of the invention as thus far described, the degree of submersion of the exhaust gas discharge 43 depends upon the speed of travel of the watercraft through the body of water in which it is operating. It is known also that outboard motors operate in conjunction with certain types of watercraft which never achieve a planing condition and hence the outboard motor underwater exhaust gas discharge does not significantly change its depth. However, with this type of application, it is the practice to position the underwater exhaust gas discharge in proximity to the propeller so that as the propeller rotates at higher speeds it will tend to operate to draw the exhaust gases from the exhaust gas discharge. As a result, this type of application also has a decreasing exhaust gas pressure at the underwater outlet at high engine speeds. This type of application is also considered to be within the scope encompassed by the term "the degree of submersion of the exhaust gas outlet depending upon the speed of travel" as used in this specification and claims.

It should be readily apparent from the foregoing description that a number of embodiments of the invention have been illustrated and described, each of which is effective to control engine operation in response to parameters including exhaust gas pressure. Although a number of embodiments have been illustrated and described, various changes and modifications can be made from even those embodiments without departing from the spirit and scope of the invention, as defined by the appended claims.

I claim:

1. An outboard motor comprising a powerhead including a two cycle, crankcase compression, internal combustion engine driving a crankshaft, a lower unit depending from said powerhead and carrying propulsion means driven by said crankshaft, said outboard motor comprising an exhaust port in said engine for receiving exhaust gases and discharging them, an exhaust system extending from said exhaust port through said lower unit and terminating in an underwater exhaust gas outlet for discharging exhaust gases from the engine to the atmosphere through the body of water in which said outboard motor is operating, the degree of submersion of said exhaust gas outlet depending upon the speed of travel of said outboard motor through the body of water, an exhaust control valve in said exhaust system for controlling the flow of exhaust gases therethrough, and means for regulating the position of said exhaust control valve in response to the position of a throttle in the induction system of the engine.

2. An outboard motor comprising a powerhead including a two cycle, crankcase compression, internal combustion engine driving a crankshaft, a lower unit depending from said powerhead and carrying propulsion means driven by said crankshaft, said outboard motor comprising an exhaust port in said engine for receiving exhaust gases and discharging them, an exhaust system extending from said exhaust port through said lower unit and terminating in an underwater exhaust gas outlet for discharging exhaust gases from the engine to the atmosphere through the body of water in which said outboard motor is operating, the degree of submersion of said exhaust gas outlet depending upon the speed of travel of said outboard motor through the body of water, an exhaust control valve in said exhaust system for controlling the flow of exhaust gases therethrough, and means for regulating the position of said exhaust control valve in response to exhaust gas pressure and another engine operating characteristic.

3. An outboard motor as set forth in claim 2 wherein the other engine operating characteristic is engine speed.

4. An outboard motor as set forth in claim 2 wherein the other engine operating characteristic is the position of a throttle valve in the engine induction system.

5. An outboard motor comprising a powerhead including a two cycle, crankcase compression, internal combustion engine driving a crankshaft, a lower unit depending from said powerhead and carrying propulsion means driven by said crankshaft, said outboard motor comprising an exhaust port in said engine for receiving exhaust gases and discharging them, an exhaust system extending from said exhaust port through said lower unit and terminating in an underwater exhaust gas outlet for discharging exhaust gases from the engine to the atmosphere through the body of water in which said outboard motor is operating, the degree of submersion of said exhaust gas outlet depending upon the speed of travel of said outboard motor through the body of water, an exhaust control valve in said exhaust system for controlling the flow of exhaust gases therethrough, and means for regulating the position of said exhaust control valve in response to an engine operating characteristic, said exhaust control valve further controlling the opening of a decompression passage leading from the combustion chamber to the exhaust system.

6. An outboard motor as set forth in claim 5 wherein the engine operating characteristic is speed.

7. An outboard motor as set forth in claim 5 wherein the engine operating characteristic is position of a throttle valve in the induction system.

8. An outboard motor as set forth in claim 5 wherein the engine operating characteristic is exhaust gas pressure.

9. An outboard motor as set forth in claim 8 wherein the engine exhaust control valve is further controlled in response to another engine operating characteristic.

10. An outboard motor as set forth in claim 9 wherein the other engine operating characteristic is engine speed.

11. An outboard motor as set forth in claim 9 wherein the other engine operating characteristic is the position of a throttle valve in the engine induction system.

12. An outboard motor comprising a powerhead including a two cycle, crankcase compression, internal combustion engine driving a crankshaft, a lower unit depending from said powerhead and carrying propulsion means driven by said crankshaft, said outboard motor comprising an exhaust port in said engine for receiving exhaust gases and discharging them, an exhaust system extending from said exhaust port through said lower unit and terminating in an underwater exhaust gas outlet for discharging exhaust gases from the engine to the atmosphere through the body of water in which said outboard motor is operating, the degree of submersion of said exhaust gas outlet depending upon the speed of travel of said outboard motor through the body of water, a decompression passage extending from the combustion chamber of the engine to said exhaust system, a decompression control valve in said decompression passage for controlling the flow therethrough, and means for regulating the position of said decompression control valve in response to the position of a throttle valve in the induction system of the engine.

13. An outboard motor comprising a powerhead including a two cycle, crankcase compression, internal combustion engine driving a crankshaft, a lower unit depending from said powerhead and carrying propulsion means driven by said crankshaft, said outboard motor comprising an exhaust port in said engine for receiving exhaust gases and discharging them, an exhaust system extending from said exhaust port through said lower unit and terminating in an underwater exhaust gas outlet for discharging exhaust gases from the engine to the atmosphere through the body of water in which said outboard motor is operating, the degree of submersion of said exhaust gas outlet depending upon the speed of travel of said outboard motor through the body of water, a decompression passage extending from the combustion chamber of the engine to said exhaust system, a decompression control valve in said decompression passage for controlling the flow therethrough, and means for regulating the position of said decompression control valve in response to an engine exhaust gas pressure and another engine operating characteristic.

14. An outboard motor as set forth in claim 13 wherein the other engine operating characteristic is engine speed.

15. An outboard motor as set forth in claim 13 wherein the other engine operating characteristic is the position of a throttle valve in the engine induction system.

* * * * *